US010334994B1

(12) United States Patent
Burd

(10) Patent No.: US 10,334,994 B1
(45) Date of Patent: Jul. 2, 2019

(54) BODY SCRUBBER HOLDING APPARATUS

(71) Applicant: Kenneth S. Burd, Port Charlotte, FL (US)

(72) Inventor: Kenneth S. Burd, Port Charlotte, FL (US)

(73) Assignee: Reach Your Clean, LLC, Port Charlotte, FL (US)

( * ) Notice: Subject to any disclaimer, the term of this patent is extended or adjusted under 35 U.S.C. 154(b) by 0 days.

(21) Appl. No.: 16/148,599

(22) Filed: Oct. 1, 2018

Related U.S. Application Data

(60) Provisional application No. 62/763,351, filed on Jun. 13, 2018.

(51) Int. Cl.
*A47K 7/02* (2006.01)
*A47L 13/44* (2006.01)

(52) U.S. Cl.
CPC ..... *A47K 7/028* (2013.01); *A47K 7/022* (2013.01); *A47L 13/44* (2013.01); *A46B 2200/1006* (2013.01)

(58) Field of Classification Search
CPC ..... A47K 7/028; A47K 7/022; A47K 7/02; A47L 13/44; A47L 13/46; A46B 2200/1006; A46B 5/0095; A46B 7/04; A46B 7/042
USPC ..... 15/229.11, 229.13, 176.4, 176.5
See application file for complete search history.

(56) References Cited

U.S. PATENT DOCUMENTS 455,567 A * 7/1891 Kraft ..... A47L 13/16 15/118
3,345,669 A * 10/1967 Starry ..... A47K 7/028 15/143.1
4,475,836 A 10/1984 Colognori
4,615,066 A 10/1986 Colognori
6,276,022 B1 8/2001 Gallacher
6,557,204 B2 5/2003 Maxwell
7,331,080 B2 * 2/2008 Chen ..... A47K 7/028 15/110
7,469,442 B1 12/2008 Matheson
8,967,898 B1 3/2015 Dayeh
(Continued)

OTHER PUBLICATIONS

AXE Detailer Shower Tool. 2018 Unilever. Date Accessed: Oct. 1, 2018: https://www.axe.com/us/en/products/body-wash/detailer-shower-tool.html.

*Primary Examiner* — Laura C Guidotti
(74) *Attorney, Agent, or Firm* — Paul Murty; Smith & Hopen, P.A.

(57) ABSTRACT

A body scrubber holder apparatus including a rigid handle portion, a flexible body portion, and a holder portion including a holding aperture and designed to receive and retain a body scrubber. The holder portion includes retention pins extending transversely away from the body of the holder portion and into the holding aperture, such that the retention pins can fit into slots on a body scrubber or other device. The holder apparatus is shaped such that the strain force experienced by the apparatus is concentrated on the flexible body portion, which can flex when experiencing strain, and rebound to an original orientation when no longer experiencing strain. The strain force being concentrated on the body portion (as opposed to on the connection between the holder and the cleaning device) provides an advantage the strain force does not risk the breakage of the retention mechanism of the holder portion.

18 Claims, 5 Drawing Sheets

(56) References Cited

U.S. PATENT DOCUMENTS

| | | | | |
|---|---|---|---|---|
| 9,498,092 | B2 * | 11/2016 | Chang | A47K 7/028 |
| 2010/0034573 | A1 * | 2/2010 | Moyers | A46B 5/0033 401/6 |

* cited by examiner

BODY SCRUBBER HOLDING APPARATUS

CROSS-REFERENCE TO RELATED APPLICATIONS

This nonprovisional application is a continuation of and claims priority to provisional application No. 62/763,351, entitled "AXE Handle," filed Jun. 13, 2018 by the same inventor.

BACKGROUND OF THE INVENTION

1. Field of the Invention

This invention relates, generally, to a holding apparatus. More specifically, it relates to a holding apparatus for use in combination with a cleaning device, such as a body scrubber, to retain the scrubber and allow a user to reach remote and difficult-to-reach places for cleaning.

2. Brief Description of the Prior Art

Body scrubbers and other cleaning devices allow a user to indirectly clean areas without directly contacting the areas to be cleaned. For example, loofahs may be employed while bathing to replace the need for a user to directly apply soap or other cleaning supplies to his or her body. Instead, the soap or other cleaning supplies can be applied directly to the loofah, with the loofah being used to clean the user's body. Another example is the shower tool product sold under the trade name AXE®, such as the AXE® Detailer shower tool.

Similarly, devices with handles are used to help a user reach a remote area for cleaning, such as the user's back or legs. In particular, if the user suffers from a physical handicap or disability, cleaning certain parts of his or her body may be difficult or impossible without the aid of a cleaning device. Such devices are typically highly specialized, and do not allow for the removal of the cleaning portion from the handle for replacement by another cleaning device. Instead, the user typically must replace the entire device, including the handle and the cleaning portion, which increases the costs associated with the device.

Attempts have been made to provide a handle that is detachable from a cleaning implement, so that the handle does not need to be replaced with the cleaning implement. An example of such a device is found in U.S. Pat. No. 6,557,204 to Maxwell. While the device disclosed in the Maxwell reference includes a handle and a head specially designed to hold a sponge or loofah, the retention mechanism in the head portion of the device fails to secure the cleaning implement to the handle. In the Maxwell reference, a string attached to the cleaning implement is threaded through a slot in the head of the holder device, thereby retaining the cleaning implement against the handle. However, such a retention mechanism is not secure, in that the retention relies on the interaction between a string and a slot. In particular, in a wet environment, such as a shower or bath, such a retention mechanism could fail if the string gets wet and slips out of the slot, thereby disconnecting the cleaning implement from the handle. A similar retention mechanism and device is disclosed in U.S. Pat. No. 6,276,022 to Gallacher, as well as in U.S. Pat. No. 7,469,442 to Matheson, with the devices suffering from similar drawbacks as the Maxwell device.

Similarly, U.S. Pat. Nos. 4,475,836 and 4,615,066, both to Colognori, propose handles with retention mechanism more complex than simply slots through which strings can be fed.

The '836 Colognori reference discusses a tong-long retention mechanism, where the handle includes a pivot point disposed between two components that, when clamped together, are designed to retain a cleaning implement. However, the tongs must clamp around the cleaning implement to prevent the cleaning implement from detaching from the holder device. As such, a user or other mechanism must hold the components of the tongs together to prevent detachment. The '066 Colognori reference discusses a circular body defining an aperture sized to receive a sponge, with a retention pin used to secure the sponge within the aperture. The retention pin couples to diametrically-opposed ends of the circular body, and passes through the sponge, to keep the sponge in place. However, such a mechanism is cumbersome in that a user must maneuver the pin by removing it from the circular body in order to change the sponge. Moreover, the pin must pass through the sponge, potentially damaging the cleaning implement and forcing the user to replace the cleaning implement at an accelerated rate.

U.S. Pat. No. 8,967,898 to Dayeh describes yet another attempt to provide a holder device couplable with a cleaning implement. In the Deyah reference, the holder device includes a pair of locking tabs that project from the body of the holder device along the same axis as the handle. The cleaning implement includes a pair of slots designed to receive the locking tabs, thereby coupling the cleaning implement with the holder device. However, in use, a majority of the stress on the device would be focused on the connection point between the handle and cleaning implement, because a user grips the handle and uses it to scrub his or her body with the cleaning implement. As such, such a retention mechanism that uses a pair of locking tabs projecting along a parallel axis from the handle is prone to breaking as a result of stress placed on the connection during use.

Accordingly, what is needed is a body scrubber holding apparatus including a retention mechanism that secures a cleaning implement to a holder device, which does not focus the stress experienced by the apparatus during use on the connection between the cleaning implement and the holder. For example, what is needed is a device than can operate as an extended handle for a shower tool, such as the products sold under the trade name AXE® Detailer shower tool. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a body scrubber holder apparatus that forms a secure connection with a body scrubber, that is flexible, and that includes a reduced risk of breaking during use, is now met by a new, useful, and nonobvious invention.

The novel structure includes a proximal end including a handle, and a distal end including a holder portion. A body portion is disposed between the proximal and distal ends, with the body portion being coupled to each of the handle and the holder portion. The body portion is flexible, such that it is arced in shape in a first orientation in the absence of a strain force, with the body portion being non-coplanar with the holder portion. The flexibility of the body portion is such that it is capable of bending to a second orientation that is substantially coplanar with the holder portion when experiencing the strain force. The body portion returns to the first orientation when no longer experiencing the strain force.

The holder portion includes a frame having a top surface, a bottom surface, and a side wall connecting the top surface with the bottom surface. The top surface includes a top diameter, and the bottom surface includes a bottom diameter that is smaller than the top diameter. In an embodiment, the bottom surface also includes a lip extending radially from the side wall of the frame. The top surface, bottom surface, and side wall define a holding aperture that is shaped such that a cleaning implement can be retained by the frame. The holding aperture is shaped such that opposing surfaces of a dual-surface cleaning implement can be used in combination with the holding aperture, with at least one surface being accessible via the holding aperture.

A plurality of retention pins extending transversely from the lip toward the holding aperture. In an embodiment, the plurality of retention pins including two pairs of diametrically-opposed retention pins arranged on the lip in a rectangular orientation. The frame is adapted to receive and retain a cleaning implement thereto, such that the cleaning implement is disposed within the holding aperture and rests on the lip. In addition, the plurality of retention pins are adapted to be at least partially secured within slots in the cleaning implement.

In an embodiment, the handle includes a grip that further includes a plurality of grooves adapted to aid a user in gripping and maneuvering the holder apparatus. In an embodiment, the handle is hollow and cylindrical in shape, having a diameter greater than a diameter of the body portion, such that the handle surrounds and secures against the body portion at the proximal end of the holder apparatus. An aperture may be disposed at the proximal end of the holder apparatus, proximate to the handle, such that a hook may be used to hang the holder apparatus for storage.

An object of the invention is to provide a holder apparatus to be used in combination with a body scrubber, with the holder apparatus being flexible enough to bend along a middle portion while experiencing strain during use, without breaking. As such, an object of the invention is to provide a strain point that is disposed away from a point of retention between the holder apparatus and the body scrubber, such that the retention mechanism is not prone to breaking during use.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a body scrubber holder apparatus including a rigid handle portion, a flexible body portion, and a holder portion designed to receive and retain a body scrubber. The holder portion includes a plurality of retention pins extending transversely away from the body of the holder portion (which is oriented along a longitudinal axis, as described in greater detail below), such that the retention pins can fit into slots on a body scrubber or other device. The holder apparatus is shaped such that the flexible body portion is longer than each of the handle portion and the holder portion, such that the strain experienced by the apparatus is concentrated on the flexible body portion. As such, the body portion is flexible because it can flex when experiencing strain, and rebound to an original orientation when no longer experiencing strain. In addition, the strain being concentrated on the body portion (as opposed to on the connection between the holder and the cleaning device) provides an advantage over prior art holders, in that the strain does not risk the breakage of the retention mechanism.

Figure 1:
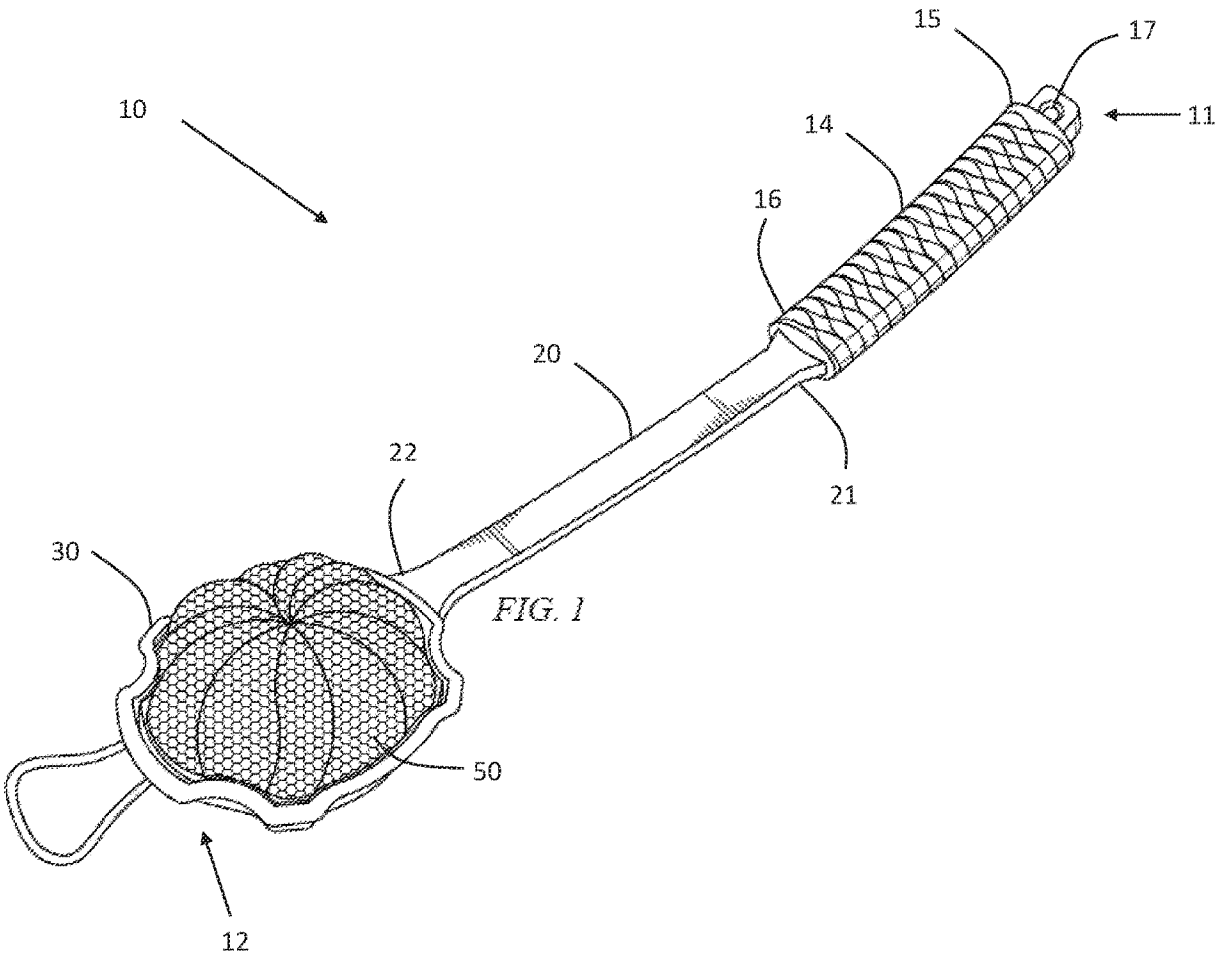
FIG. 1 is a perspective view of a body scrubber holder apparatus, showing the holder apparatus retaining a body scrubber therein.

Referring now to FIG. 1, an embodiment of body scrubber holder apparatus 10 is shown in greater detail. Holder apparatus 10 includes proximal end 11 opposite distal end 12. Handle 14 is disposed adjacent to proximal end 11 of holder apparatus 10, with handle 14 providing a gripping portion for a user to grip and maneuver holder apparatus 10 during use. Holder portion 30 is disposed adjacent to distal end 12 of holder apparatus 10, with holder portion 30 providing an attachment point for body scrubber 50 to be secured to holder apparatus 10, such that a user can use body scrubber 50 by gripping and maneuvering holder apparatus 10. Flexible body portion 20 is disposed between proximal end 11 and distal end 12, with body portion 20 indirectly coupling holder portion 30 with handle 14.

Handle 14 includes proximal end 15, which is disposed adjacent to proximal end 11 of holder apparatus. Aperture 17 is disposed adjacent to proximal end 15 of handle 14, with aperture 17 providing an attachment point for a hook or other exterior retention implement, such that holder apparatus 10 may be hung up and stored via aperture 17. Aperture 17 is shown in FIG. 1 as being separate from handle 14, disposed between proximal end 15 of handle 14 and proximal end 11 of holder apparatus 10; however, it is appreciated that aperture 17 may be disposed on handle 14, or at another location of holder apparatus 10, so long as holder apparatus can be stored via aperture 17.

In addition, handle 14 includes distal end 16, which is disposed adjacent to flexible body portion 20, which is between proximal end 11 and distal end 12 of holder apparatus 10. The body of handle 14, from proximal end 15 to distal end 16, is shown in FIG. 1 as having a scored or grooved pattern to provide comfort for the user upon gripping handle 14; however, it is appreciated that other grip patterns are contemplated, including solid grips without distinct patterns, so long as the user can comfortably grip handle 14.

Handle 14 couples to flexible body portion 20, such that a user gripping handle 14 can maneuver body portion 20 as well. In an embodiment, handle 14 is a hollow grip that has a diameter greater than that of body portion 20, such that handle 14 surrounds body portion 20. Alternatively, in an embodiment, handle 14 has a substantially solid body, and distal end 16 of handle 14 secures to body portion 20, such as by adhesive, welding, or a design choice during a manufacturing process, such as if the components of holder apparatus 10 are formed from a single piece of material.

Flexible body portion 20 includes proximal end 21 opposite distal end 22. The length spanning between proximal end 21 and distal end 22 is oriented substantially along the longitudinal axis of holder apparatus 10 (which spans from proximal end 11 to distal end 12). As shown in FIG. 1, flexible body portion 20 is elongated, such that the length spanning between proximal end 21 and distal end 22 is longer then a width disposed between the parallel sides of body portion 20. Due to the ratio of length to width, the elongated body portion 20 is flexible, such that body portion 20 is capable of bending without breaking along the longitudinal length thereof.

The flexibility of body portion 20 is an important aspect of holder apparatus 10, since it reduces the risk that holder apparatus 10 breaks during use, such as if a user applies too much force while maneuvering the apparatus. For example, when a user grips handle 14 and uses the apparatus to scrub his or her back, the shape of the apparatus is such that, when holder apparatus receives a normal stress force, the strain is focused on body portion 20, and the flexibility of body portion 20 is such that there is a reduced risk of breaking since body portion 20 can bend while in use. Due to its flexibility, body portion 20 is elastically deformable along its longitudinal length, as body portion 20 can deform in response to a normal stress, while regaining its original shape and position after the normal stress is no longer acting on body portion 20. As such, body portion 20 has a relatively high normal strain value (as compared to prior art holders), and can deform in response to a normal stress while regaining its shape after the normal stress ceases to act on it.

Distal end 22 of body portion 20 is coupled to holder portion 30 of holder apparatus 10. Holder portion 30 is sized and shaped to securely retain scrubber 50 to holder apparatus 10, in a mechanism that is described in greater detail below.

Figure 2A:
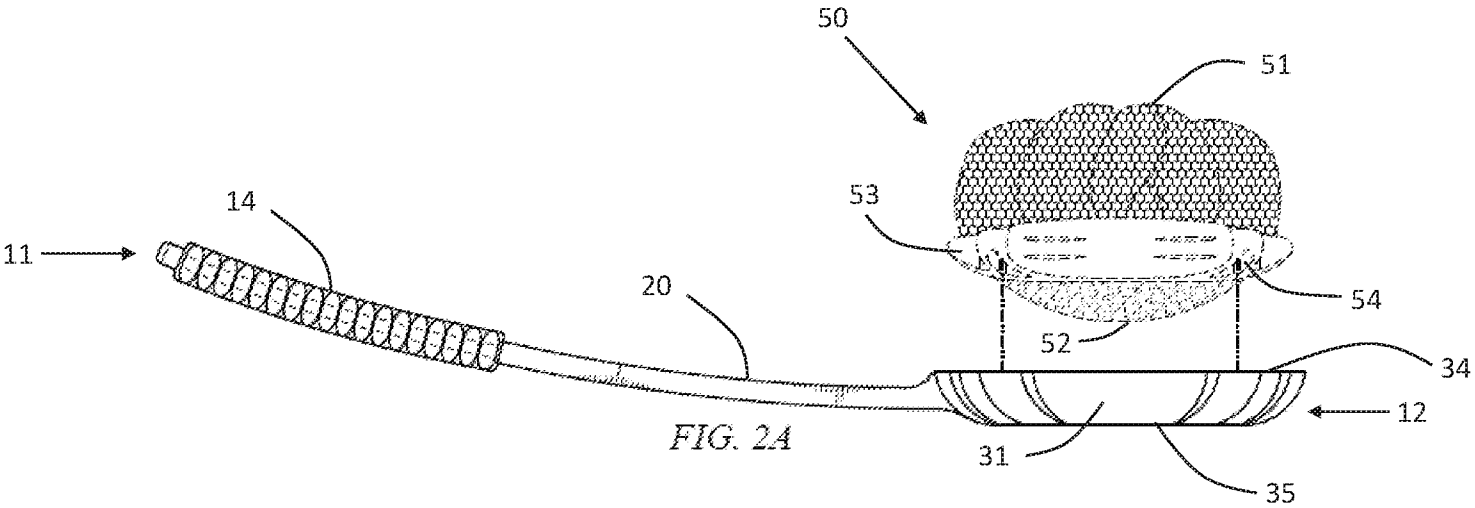
FIG. 2A is a side orthogonal view of the body scrubber holder apparatus of FIG. 1, showing a body scrubber in dotted lines, and depicting an attachment mechanism between the holder apparatus and the body scrubber.
Figure 2B:
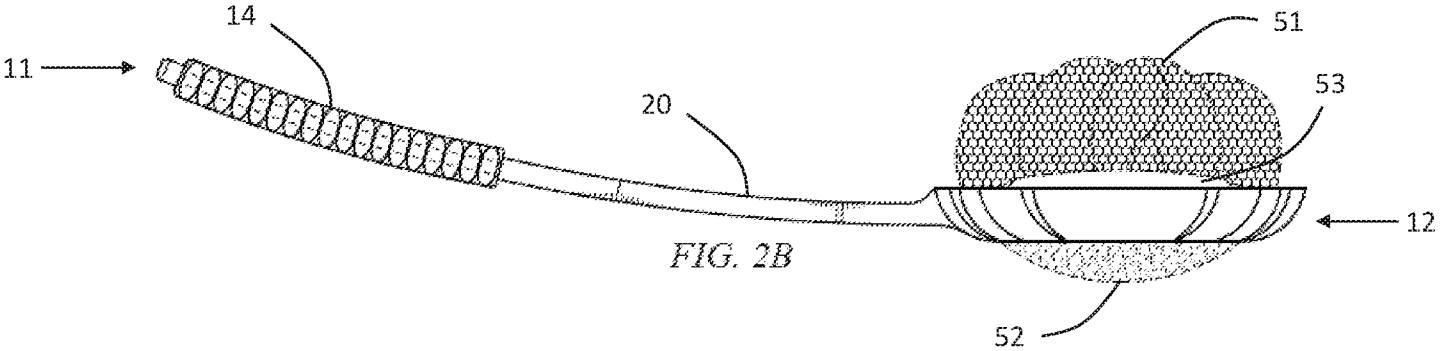
FIG. 2B is a side orthogonal view of the body scrubber holder apparatus of FIG. 2A, showing the holder apparatus retaining the body scrubber.

FIGS. 2A and 2B show holder portion 30 and scrubber 50 in greater detail, and specifically show a connection between scrubber 50 and holder portion 30 of holder apparatus 10. As FIGS. 2A and 2B show, holder portion 30 includes frame 31 which forms the body of the holder portion 30. Frame 31 includes top surface 34 and bottom surface 35, with a height disposed between top surface 34 and bottom surface 35. The height disposed between the surfaces forms a part of frame 31, and, together with top surface 34 and bottom surface 35, that provides a retention lip for scrubber 50, which will be described in greater detail below.

Frame 31 is designed to receive and retain scrubber 50 therein. Scrubber 50 includes first cleaning side 51 opposite second cleaning side 52, with scrubber frame 53 being disposed therebetween and forming the body of scrubber 50, connecting first cleaning side 51 with second cleaning side 52. Scrubber 50, as shown in FIGS. 2A and 2B, is merely exemplary of a cleaning device that can be used in combination with holder apparatus 10; however, cleaning devices having different components and different structures are contemplated to be used with holder apparatus 10, so long as the cleaning devices can be retained by holder apparatus 10. In the embodiment shown in FIGS. 2A and 2B, scrubber 50 includes a plurality of slots 54, which form a component of a retention mechanism between holder apparatus 10 and scrubber 50. The retention mechanism is discussed in greater detail below.

In addition, FIGS. 2A and 2B show the shape of holder apparatus 10 in greater detail, and specifically show the non-coplanar relationship between the components of holder apparatus 10. In particular, FIGS. 2A and 2B show that handle 14 and flexible body portion 20 are non-coplanar with frame 31 of holder portion 30. The shape and angle of handle 14 and flexible body portion 20 with respect to holder portion 30 is an important feature of holder apparatus 10, because the arced body portion 20 is bendable while holder apparatus 10 is being used, making body portion 20 flexible.

As such, when holder apparatus 10 is used in combination with scrubber 50 (or a similar cleaning device), and body portion 20 receives a normal stress as a result of the use, body portion 20 can deform to become substantially coplanar with frame 31 of holder portion 30 without breaking.

Figure 3:
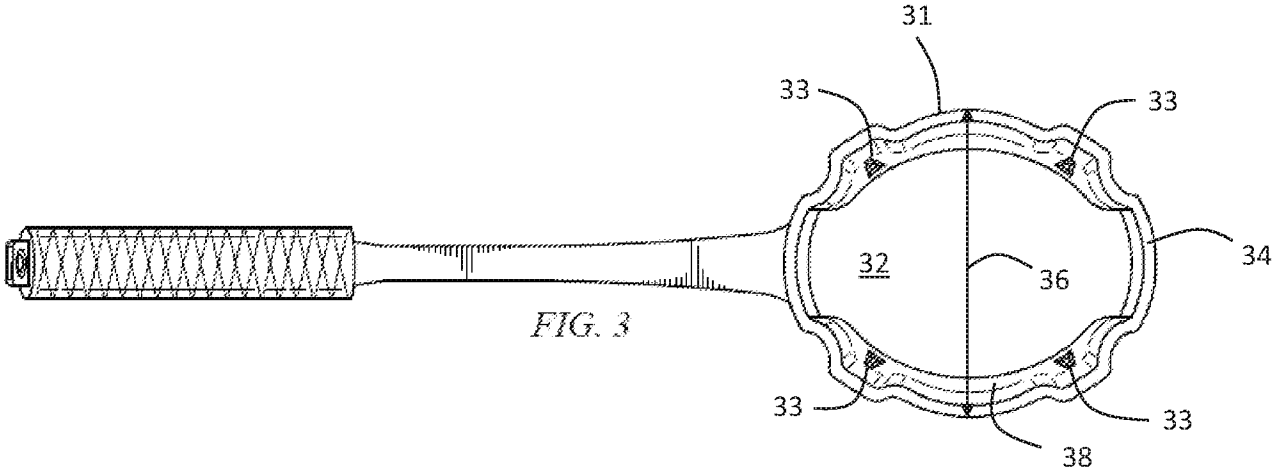
FIG. 3 is a top plan view of the body scrubber holder apparatus of FIG. 1, depicting a plurality of retention pins extending transversely from a holding portion of the holder apparatus.
Figure 4:
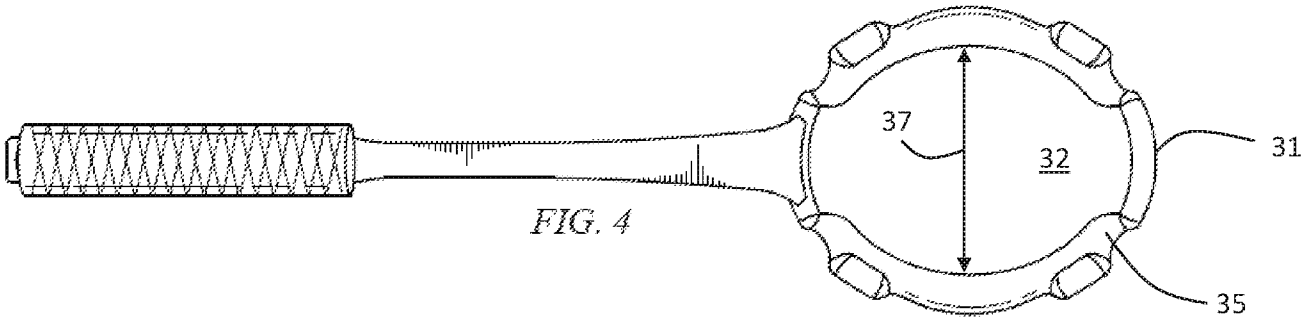
FIG. 4 is a bottom plan view of the body scrubber holder apparatus of FIG. 1.

Turning now to FIGS. 3 and 4, the retention mechanism of holder apparatus 10 is shown in greater detail. As discussed above, holder portion 30 includes frame 31, which includes top surface 34 (shown in FIG. 3) and bottom surface 35 (shown in FIG. 4). Frame 31, including top surface 34 and bottom surface 35, defines holding aperture 32. Holding aperture 32 provides a space through which scrubber 50 can be partially inserted, such that each of first cleaning side 51 and second cleaning side 52 of scrubber 50 can be used in combination with holder apparatus 10. Holding aperture 32 will be described in greater detail below.

As shown in FIG. 3, frame 31 has top diameter 36, which is a chord passing through a center point of holder portion 30 between diametrically-opposed points on top surface 34. Similarly, as shown in FIG. 4, frame 31 has bottom diameter 37, which is a chord passing through a center point of holder portion 30 between diametrically-opposed points on bottom surface 35. Top diameter 36 is greater in length than bottom diameter 37, with the difference in diameters being due to lip 38 disposed on bottom surface 35 of frame 31.

Lip 38 extends radially from the side walls 39 of frame 31 toward the center point of holder portion 30, through which top diameter 36 and bottom diameter 37 pass through. Lip 38 provides a retention surface that includes a plurality of retention pins 33 extending transversely away from lip 38, as shown in detail in FIG. 3 and discussed in greater detail below. In addition, retention pins 33 extend substantially parallel to side walls 39, which are also oriented along a transverse axis that is perpendicular to the longitudinal axis of holder apparatus 10 from proximal end 11 to distal end 12. The shape of lip 38, in combination with the plurality of retention pins 33, aid in the retention of scrubber 50 (or a similar cleaning device) on holder portion 30.

Figure 5:
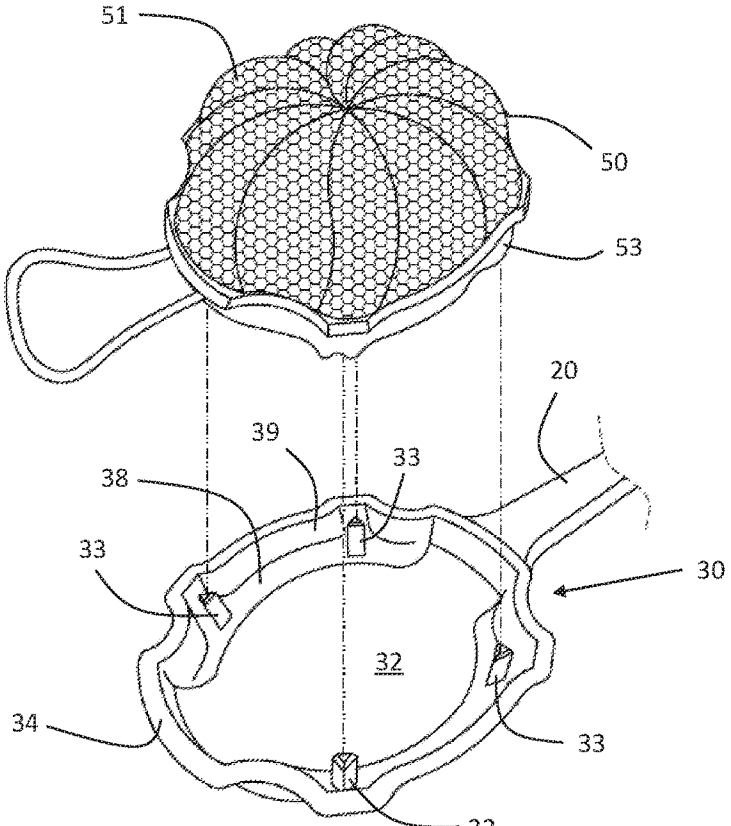
FIG. 5 is a close-up top perspective view of the holding portion of the holder apparatus, showing an attachment and retention mechanism between the retention pins of the holder apparatus and a body scrubber.
Figure 6:
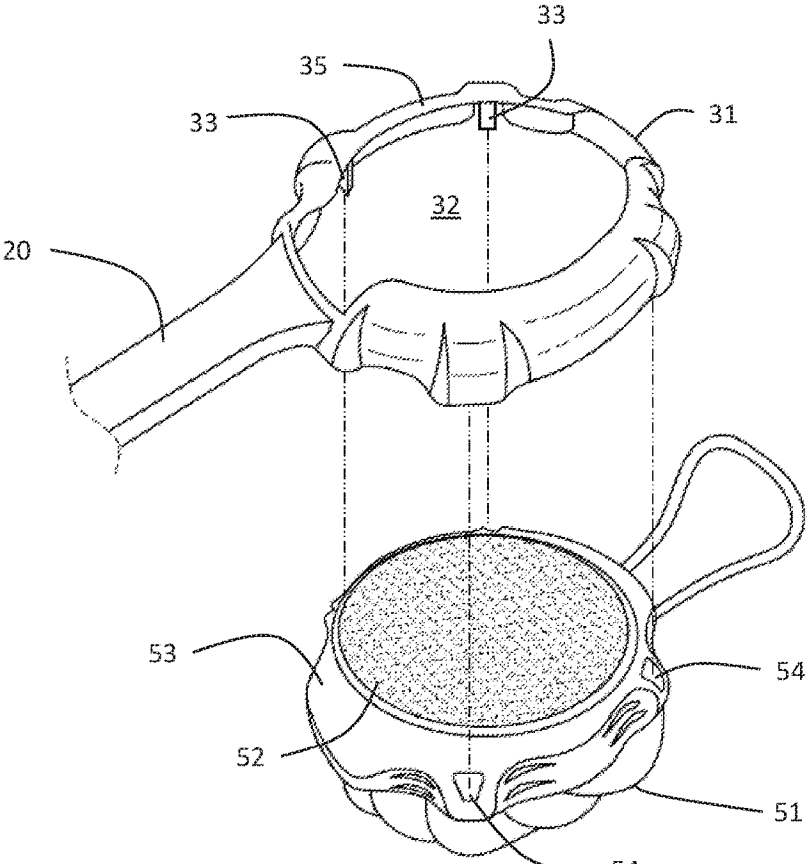
FIG. 6 is a close-up bottom perspective view of the holding portion of the holder apparatus, showing attachment points on a body scrubber that are designed to receive a plurality of retention pins, with the retention pins designed to retain the body scrubber.

FIGS. 5 and 6 show the securing of scrubber 50 to holder portion 30 of holder apparatus 10 in greater detail. As discussed above, holder portion 30 includes lip 38, which houses the plurality of retention pins 33 extending transversely away from lip 38. As shown in FIG. 6, and as discussed above in relation to FIGS. 2A and 2B, scrubber 50 includes slots 54 disposed within scrubber frame 53 thereof. The plurality of retention pins 33 extending transversely away from lip 38 are sized and shaped such that retention pins 33 are received within slots 54 disposed within scrubber frame 53 of scrubber 50. As such, one or more secure connections are formed between holder portion 30 and scrubber 50, thereby securing scrubber 50 against holder portion 30.

If scrubber 50 includes multiple cleaning sides, such as first cleaning side 51 and second cleaning side 52, it is desirable that each of the cleaning sides can be used when scrubber 50 is used in combination with holder apparatus 10. As such, holder portion 30 of holder apparatus 10 includes holding aperture 32 defined by frame 31 of holder portion 30. In particular, holding aperture 32 is defined by top surface 34, side walls 39 of frame 31, and bottom surface 35, including lip 38. Lip 38 provides a surface upon which scrubber frame 53 of scrubber 50 can reside when scrubber 50 secures against holder portion 30, forming a press fit. In combination with retention pins 53, lip 38 and side walls 39 of frame 31 form a retention mechanism for securing scrubber 50 to holder apparatus 10, such that scrubber is unlikely to disconnect or detach from holder apparatus 10 during use. When secured to holder apparatus 10, both first cleaning side 51 and second cleaning side 52 can be accessed and utilized as a result of holding aperture 32, which provides for access to one or more of the cleaning sides, depending on the orientation of scrubber 50 with respect to holder apparatus 10.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A holder apparatus comprising:

a proximal end opposite a distal end, with a handle disposed at the proximal end and a holder portion disposed at the distal end, with a body portion disposed between the proximal and distal ends, the body portion coupled to each of the handle and the holder portion;

the body portion being flexible, such that the body portion is capable of bending when experiencing a strain force, and return to its original orientation when no longer experiencing the strain force;

the holder portion including a frame having:

a top surface, a bottom surface, and a side wall connecting the top surface with the bottom surface, the top surface, bottom surface, and side wall defining a holding aperture;

a lip disposed on the bottom surface and extending radially from the side wall of the frame, such that the bottom surface includes a diameter less than a diameter of the top surface;

a plurality of retention pins disposed on the lip and extending transversely therefrom toward the holding aperture, the frame adapted to receive and retain a cleaning implement thereto, with the plurality of retention pins adapted to be at least partially secured within the cleaning implement.

2. The holder apparatus of claim 1, further comprising:

a grip disposed on the handle, the grip including a plurality of grooves adapted to aid a user in gripping and maneuvering the holder apparatus.

3. The holder apparatus of claim 1, wherein:

the handle is hollow and cylindrical in shape, having a diameter greater than a diameter of the body portion, such that the handle surrounds and secures against the body portion at the proximal end of the holder apparatus.

4. The holder apparatus of claim 1, further comprising:

an aperture disposed at the proximal end of the holder apparatus, the aperture adapted to be used in combination with a hook to hang the holder apparatus to store the holder apparatus.

5. The holder apparatus of claim 1, wherein:

the body portion is arced in shape, such that the body portion is non-coplanar with the holder portion in a first orientation when the holder apparatus is not experiencing a strain force.

6. The body scrubber holder apparatus of claim 5, wherein:

the body portion is capable of bending to a second orientation that is substantially coplanar with the holder portion when experiencing the strain force, and return to the first orientation when no longer experiencing the strain force.

7. The body scrubber apparatus of claim 1, wherein the holding aperture is shaped such that the cleaning implement can be retained by the frame.

8. The body scrubber holder apparatus of claim 1, wherein:

the frame is adapted to receive and retain the cleaning implement thereto, such that the cleaning implement resides within the holding aperture and rests on the lip, and wherein the plurality of retention pins are adapted to be at least partially secured within the cleaning implement.

9. The body scrubber holder apparatus of claim 1, wherein:

the plurality of retention pins includes two pairs of diametrically-opposed retention pins arranged on the frame in a rectangular orientation.

10. A body scrubber holder apparatus comprising:

a proximal end opposite a distal end, with a handle disposed at the proximal end and a holder portion disposed at the distal end, with a body portion disposed between the proximal and distal ends, the body portion coupled to each of the handle and the holder portion;

the holder portion including a frame having a top surface, a bottom surface, and a side wall connecting the top surface with the bottom surface, the bottom surface further including a lip extending radially from the side wall of the frame, such that the bottom surface includes a diameter less than a diameter of the top surface; and a plurality of retention pins extending transversely from the lip toward the top surface, wherein the plurality of retention pins are adapted to be at least partially secured within a dual-surface cleaning implement, such that the frame is adapted to receive and retain the dual-surface cleaning implement thereto, and such that the dual-surface cleaning implement rests on the lip.

11. The body scrubber holder apparatus of claim 10, wherein:

the body portion is flexible, such that the body portion is capable of bending when experiencing a strain force, and return to a first orientation when no longer experiencing the strain force, and being arced in shape, such that the body portion is non-coplanar with the holder portion in the first orientation.

12. The body scrubber holder apparatus of claim 11, wherein:

the body portion is capable of bending to a second orientation that is substantially coplanar with the holder portion when experiencing the strain force, and return to the first orientation when no longer experiencing the strain force.

13. The body scrubber holder apparatus of claim 10, further comprising:

a grip disposed on the handle, the grip including a plurality of grooves adapted to aid a user in gripping and maneuvering the holder apparatus.

14. The body scrubber holder apparatus of claim 10, wherein:

the handle is hollow and cylindrical in shape, having a diameter greater than a diameter of the body portion, such that the handle surrounds and secures against the body portion at the proximal end of the holder apparatus.

15. The body scrubber holder apparatus of claim 10, further comprising:

an aperture disposed at the proximal end of the holder apparatus, the aperture adapted to be used in combination with a hook to hang the holder apparatus to store the holder apparatus.

16. The body scrubber holder apparatus of claim 10, wherein:

the top surface, bottom surface including the lip, and side wall define a holding aperture that is shaped such that the dual-surface cleaning implement can be retained by the frame, such that at least one of the surfaces of the dual-surface cleaning implement can be accessed through the holding aperture.

17. The body scrubber holder apparatus of claim 10, wherein:

the plurality of retention pins includes two pairs of diametrically-opposed retention pins arranged on the frame in a rectangular orientation.

18. A body scrubber holder apparatus comprising:

a proximal end opposite a distal end, with a handle disposed at the proximal end and a holder portion disposed at the distal end, with a body portion disposed between the proximal and distal ends, the body portion coupled to each of the handle and the holder portion;

the body portion being arced in shape in a first orientation in the absence of a strain force, such that the body portion is non-coplanar with the holder portion, and being flexible, such that the body portion is capable of bending to a second orientation that is substantially coplanar with the holder portion when experiencing the strain force, and return to the first orientation when no longer experiencing the strain force;

the holder portion including a frame having a top surface, a bottom surface, and a side wall connecting the top surface with the bottom surface, the frame defining a holding aperture that is shaped such that a cleaning implement can be retained by the frame;

the top surface including a top diameter;

the bottom surface including a lip extending radially from the side wall of the frame, and including a bottom diameter that is smaller than the top diameter;

a plurality of retention pins extending transversely from the lip toward the holding aperture, the plurality of retention pins including two pairs of diametrically-opposed retention pins arranged on the lip in a rectangular orientation;

wherein the frame is adapted to receive and retain a cleaning implement thereto, such that the cleaning implement is disposed within the holding aperture and rests on the lip, and wherein the plurality of retention pins are adapted to be at least partially secured within the cleaning implement.

* * * * *